US008529312B2

(12) United States Patent
Kritzky et al.

(10) Patent No.: US 8,529,312 B2
(45) Date of Patent: Sep. 10, 2013

(54) NOZZLE FOR COOLING LUBRICANT

(75) Inventors: Marc Kritzky, Hamburg (DE); Dieter Muchow, Henstedt Ulzburg (DE); Alexander Foethke, Henstedt Ulzburg (DE); Dietmar Paehler, Norderstedt (DE)

(73) Assignee: Saint-Gobain Diamantwerkzeuge GmbH & Co. KG, Norderstedt (DE)

( * ) Notice: Subject to any disclaimer, the term of this patent is extended or adjusted under 35 U.S.C. 154(b) by 0 days.

(21) Appl. No.: 13/807,866

(22) PCT Filed: Jul. 8, 2011

(86) PCT No.: PCT/EP2011/061592

§ 371 (c)(1),
(2), (4) Date: Feb. 20, 2013

(87) PCT Pub. No.: WO2012/004376

PCT Pub. Date: Jan. 12, 2012

(65) Prior Publication Data

US 2013/0203323 A1 Aug. 8, 2013

(30) Foreign Application Priority Data

Jul. 9, 2010 (DE) ..... 10 2010 036 316

(51) Int. Cl.
*B24B 49/00* (2012.01)

(52) U.S. Cl.
USPC ..... 451/7; 451/102

(58) Field of Classification Search
USPC ..... 451/7, 102
See application file for complete search history.

(56) References Cited

U.S. PATENT DOCUMENTS

| | | | | |
|---|---|---|---|---|
| 3,917,888 | A * | 11/1975 | Beam et al. | 427/433 |
| 4,041,895 | A * | 8/1977 | Overton et al. | 118/704 |
| 4,254,659 | A | 3/1981 | Benedetto et al. | |
| 7,727,054 | B2 * | 6/2010 | Webster | 451/102 |

FOREIGN PATENT DOCUMENTS

| | | |
|---|---|---|
| EP | 1529599 | 11/2004 |
| WO | 03/015988 | 2/2003 |

OTHER PUBLICATIONS

PCT Written Opinion completed on Jan. 9, 2013 for PCT Application PCT/EP2011/061592 filed on Jul. 8, 2011 in the name of Saint-Gobain Diamantwerkzeuge GMBH & Co. KG (English + German).
PCT International Search Report mailed on Dec. 9, 2011 for PCT Application PCT/EP2011/061592 filed on Jul. 8, 2011 in the name of Saint-Gobain Diamantwerkzeuge GMBH & Co. KG (English + German).

* cited by examiner

*Primary Examiner* — Maurina Rachuba
(74) *Attorney, Agent, or Firm* — Steinfl & Bruno LLP

(57) ABSTRACT

A nozzle for cooling lubricant is described having a connecting chamber with a chamber inlet and with a deflector plate in the interior of the connecting chamber that is held on at least two mounting means, a main chamber that is removably mounted by the rear face on the front face of the connecting chamber and has a diffusion plate with drilled holes, and a nozzle plate that is removably mounted by the rear face on the front face of the main chamber and has a hole pattern adapted to a grinding wheel profile.

15 Claims, 10 Drawing Sheets

NOZZLE FOR COOLING LUBRICANT

CROSS REFERENCE TO RELATED APPLICATIONS

Figure 1:
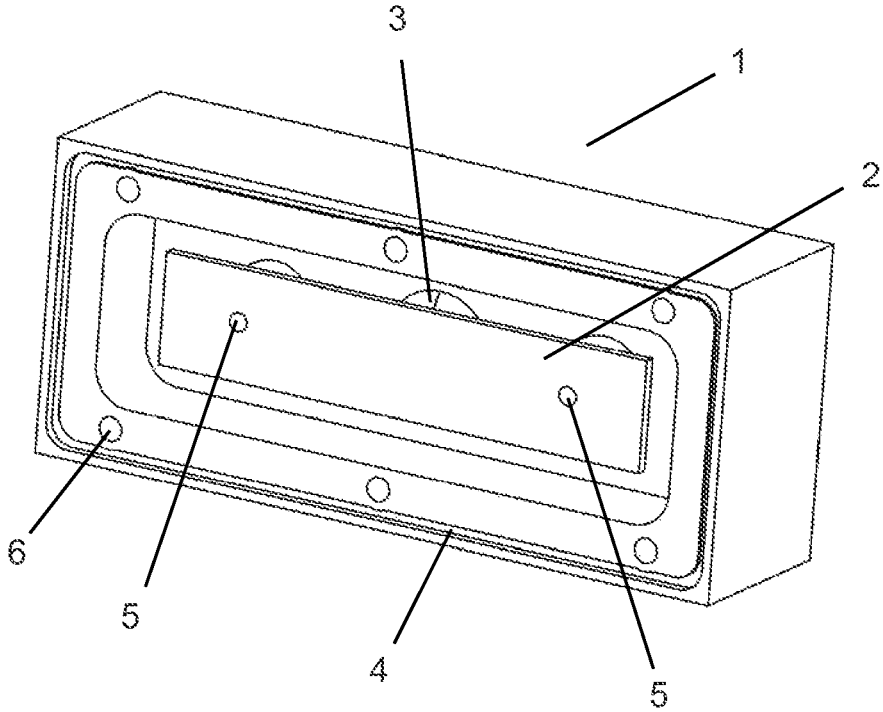

The present application is the US national stage of International Application PCT/EP2011/061592 filed on Jul. 8, 2011 which, in turn, claims priority to German Application 102010036316.2 filed on Jul. 9, 2010.

The present invention relates to a nozzle for cooling lubricant and an economical and environmentally friendly grinding method. The present invention relates in particular to supplying cooling lubricant to a point of contact between a workpiece and a tool for removal of material, in particular to supplying cooling lubricant during grinding processes.

Integration of the cooling lubricant has substantial effect on the grinding result and the service life of the grinding wheel. The combined action of pressure, flow volume, temperature, and direction of the cooling lubricant jet determines the cooling effect. The efficiency of the cooling lubrication is also substantially influenced by the nozzle design.

The most important task of the cooling lubricant (CI) is the cooling of the workpiece. The cooling lubricant must also cool the grinding wheel, minimize friction, transport the grinding chips out of the grinding zone and the entire machine, and flush the pore spaces of the grinding.

It is known to equip a grinding machine with a nozzle that can emit one or a plurality of jets, spray jets, or streams of a liquid coolant onto the point of contact between a workpiece and a tool for removal of material. Such cooling of the point of contact between a workpiece and a grinding tool advantageously influences the quality of the finished product.

It is known to design a nozzle such that it can supply appropriate amounts of coolant to the point of contact between a relatively large workpiece surface and a suitably profiled working surface of a rotary grinding wheel or a similar tool in a suitable distribution. When a special grinding tool is replaced by another grinding tool with a different profile, it is generally necessary to replace the nozzle with a different type of nozzle, in a time-consuming operation, which can result in shutting down the machine for long periods of time.

Another factor that influences the quality of workpiece cooling is the dispersion of the coolant jet supplied to the workpiece. Dispersion is disadvantageous because it tends to increase entrained air. The air tends to somewhat exclude coolant from the grinding zone and, consequently, from the interface between the grinding wheel and the workpiece.

It is also known that the quality of workpiece cooling can be improved by adapting the speed of the coolant jet to that of the grinding surface of the grinding wheel.

From WO 2003/015988 A1, a nozzle assembly is known that comprises a plenum chamber and a modular front plate that is removably fastened to a downstream side of the plenum chamber. The assembly also includes at least one nozzle for coherent jets to transport coolant through the modular front plate and a pretreatment device disposed inside the plenum chamber.

From U.S. Pat. No. 3,917,888, a method and a device for coating a substrate are known. Therein, a nozzle is described that includes a wall provided with perforations, in the interior, counter to the direction of flow in the entire width. The wall aids the distribution of the aft or liquid flowing in the interior of the nozzle. In addition, a screen situated counter to the direction of flow for additional aid in the distribution of the liquid is described.

A common disadvantage of known nozzles and nozzle arrangements resides in that the coolant swirls inside the chamber and the laminar outflow is destroyed. Pure cooling lubricant is not introduced into the grinding region, but, instead, an emulsion of air and cooling lubricant. The cooling effect suffers substantially. Burn marks are formed on the process workpieces. A lower throughput of workpieces is achieved.

The object of the present invention consists in providing a nozzle for grinding applications with which the grinding performance is increased and burn marks on the workpiece are avoided.

The object is accomplished by means of a nozzle for cooling lubricant, comprising

- a connecting chamber with a chamber inlet and with a deflector plate in the interior of the connecting chamber that is held on at least two mounting means,
- a main chamber that is removably mounted by the rear face on the front face of the connecting chamber and has a diffusion plate with drilled holes, and
- a nozzle plate that is removably mounted by the rear face on the front face of the main chamber and has a hole pattern adapted to a grinding wheel profile.

The nozzle for cooling lubricant according to the invention preferably includes three parts, the connecting chamber with the deflector plate, the main chamber with the diffusion plate, and a nozzle plate. The deflector plate is a solid plate that has no drilled holes for passage of the cooling lubricant.

The cooling lubricant can be introduced with a pressure up to 5 bar. With the nozzle according to the invention, there is still laminar coolant flow after a distance of roughly 1 mm. Pure cooling lubricant is introduced into the grinding region, not an emulsion of aft and cooling lubricant as with known methods with known nozzles.

Through incorporation of the cooling lubricant in the device according to the invention, the following advantages are obtained. The intervals between dressing operations are increased due to less abrasive grit wear. Grinding burn is reduced and higher removal rates are obtained. The flow volume provided is used efficiently, by means of which the total flow volume is reduced. The amount of co-mingled air is minimized and, thus, resultant foaming, nebulization, and evaporation. A grinding wheel can be dressed with higher cutting speeds and with hard bonds.

The device according to the invention can be easily assembled and uses less coolant than known nozzles because a specific jet is produced. Laminar flow with extremely little air is generated.

The cooling lubricant enters the connecting chamber. The connecting chamber has a groove for an O-ring and holes for the screws. The plate in the connecting chamber is the deflector plate. The cooling lubricant enters the connecting chamber with a large flow volume of roughly 300 L/m from the rear face. The cooling lubricant flows according to the invention with homogeneous flow through the entire diffusion plate. With the deflector plate, the cooling lubricant does not arrive directly into the main chamber, and the diffusion plate is not impinged on only in the center. Without the deflector plate, the cooling lubricant would arrive directly into the main chamber and only come into the center of the diffusion plate. A much higher flow volume would develop in the center than at the edges. Thus, the laminar flow would break down.

According to the invention, homogeneous pressure is produced in the main chamber. In the main chamber, the cooling lubricant is calmed such that it is squeezed out via the output nozzle only to the extent that laminar flow is obtained. The homogeneous pressure in the main chamber has the effect that a uniform jet develops over the profile. The jet is laminar and does not disintegrate. Thus, grinding is accomplished cooler according to the invention because the cooling is more selective, in particular because cooling is more selective due to the profile.

The Q/M value can be increased in accordance with the invention. The "Q/M value" means the material removal of the grinding wheel on one millimeter of grinding wheel width per unit of time. Pump capacity and energy are reduced.

The nozzle according to the invention yields laminar flow; consequently, there are no air inclusions in the coolant which act as insulators. Grinding can be accomplished cooler and the grinding performance can thus be increased. The workpiece has fewer burn marks.

A preferred embodiment of the nozzle according to the invention resides in that the diffusion plate with drilled holes is installed in the bottom of the main chamber. Another preferred embodiment of the nozzle according to the invention resides in that the drilled holes extend over the entire inner surface of the bottom of the main chamber. This contributes advantageously to the calming of the cooling lubricant in the main chamber.

A preferred embodiment of the nozzle according to the invention resides in that the deflector plate in the connecting chamber is positioned over the chamber net such that the cooling lubricant is distributed in the connecting chamber before it impinges on the diffusion plate of the main chamber. Another preferred embodiment of the nozzle according to the invention resides in that the size of the surface of the deflector plate is at least 50% of the inner surface of the bottom of the connecting chamber. The deflector plate is situated parallel to the bottom of the connecting chamber. The distance between the deflector plate and the inner surface of the bottom of the connecting chamber corresponds to at least 50% of the distance between the inner surface of the bottom of the connecting chamber and the top edge of the side walls of the connecting chamber.

The connecting chamber is preferably from 180 mm to 200 mm wide, preferably from 70 mm to 90 mm deep, and preferably from 45 mm to 60 mm high. The deflector plate is situated preferably from 10 mm to 20 mm above the inner surface of the bottom of the connecting chamber. The deflector plate is preferably from 2 mm to 5 mm thick, preferably from 20 mm to 40 mm wide, and preferably from 130 mm to 150 mm long. The deflector plate is positioned above the chamber inlet such that the cooling lubricant is distributed in the connecting chamber before it impinges on the diffusion plate in the main chamber. Thus, advantageously, according to the invention, the laminar flow of the cooling lubricant is effected.

A preferred embodiment of the nozzle according to the invention resides in that the front face of the connecting chamber and the front face of the main chamber have grooves for O-rings. Another preferred embodiment of the nozzle according to the invention resides in that the connecting chamber, the main chamber, and the nozzle plate have screw openings for connecting. Another preferred embodiment of the nozzle according to the invention resides in that the connecting chamber, the main chamber, and the nozzle plate are connected by screws in screw openings and O-rings in grooves to form a device. The three parts of the nozzle structure can advantageously be sealed watertightly. This prevents any loss of cooling lubricant and enables environmentally sound handling of the nozzle according to the invention.

A preferred embodiment of the nozzle according to the invention resides in that the drilled holes in the diffusion plate have a diameter of 2 mm to 4 mm. Another preferred embodiment of the nozzle according to the invention resides in that the drilled holes in the nozzle plate have a diameter of 1 mm to 3 mm. Thus, advantageously, according to the invention, the laminar flow of the cooling lubricant is effected. The nozzle plate is also referred to as output nozzle plate or homogenization plate.

A preferred embodiment of the nozzle according to the invention resides in that the connecting chamber with deflector plate, main chamber, and nozzle plate contain aluminum or alloyed high-grade steel. Aluminum is particularly well-suited for production of the nozzle parts.

The object of the invention is further accomplished by a method of emitting a coherent jet of cooling lubricant onto a grinding wheel with a nozzle for cooling lubricant according to the invention, wherein

- a nozzle plate with a hole pattern adapted to the grinding wheel profile is used,
- a desired cooling lubricant flow rate is set by setting a specific cooling lubricant pressure for a grinding process, and
- a grinding wheel peripheral speed is set.

An advantageous embodiment of the invention resides in that the cooling lubricant flow rate corresponds roughly to the grinding wheel peripheral speed. With these speeds, very good results are obtained. Another advantageous embodiment of the invention resides in that a laminar flow is created by the nozzle. Through the laminar flow of the cooling lubricant, very good results are obtained on the workpiece and good throughput is obtained.

The object is further accomplished through the use of the nozzle according to the invention to supply cooling lubricant to a point of contact between a workpiece and a tool for removal of material, in particular to supply cooling lubricant during grinding processes.

Figure 2:
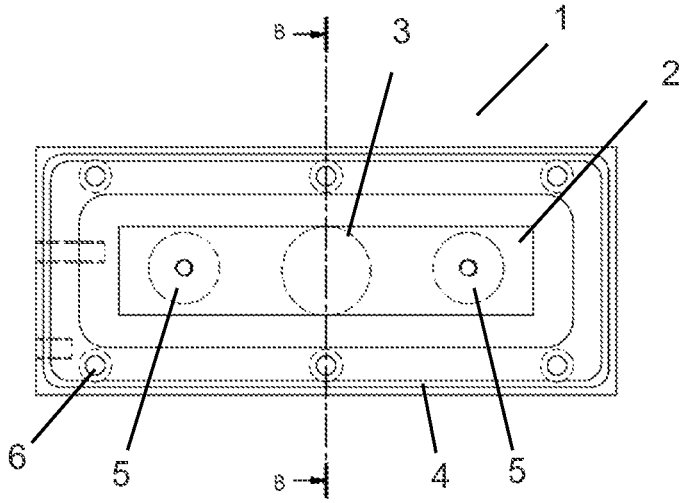

The invention is explained in detail in the following with reference to drawings and an example. The drawings are not completely true to scale. The invention is in no way restricted by the drawings. They depict:

FIG. 1 a spatial view from above of the connecting chamber with deflector plate, FIG. 2 a top plan view of the connecting chamber with deflector plate.

Figure 2A:
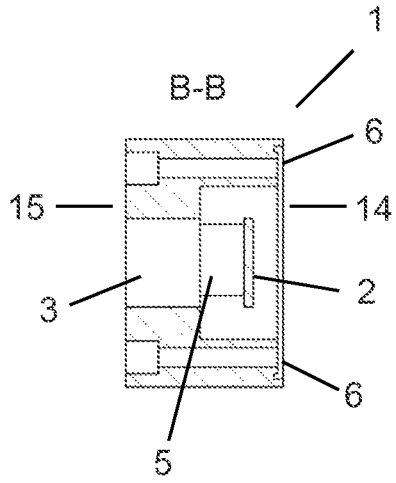
Figure 3:
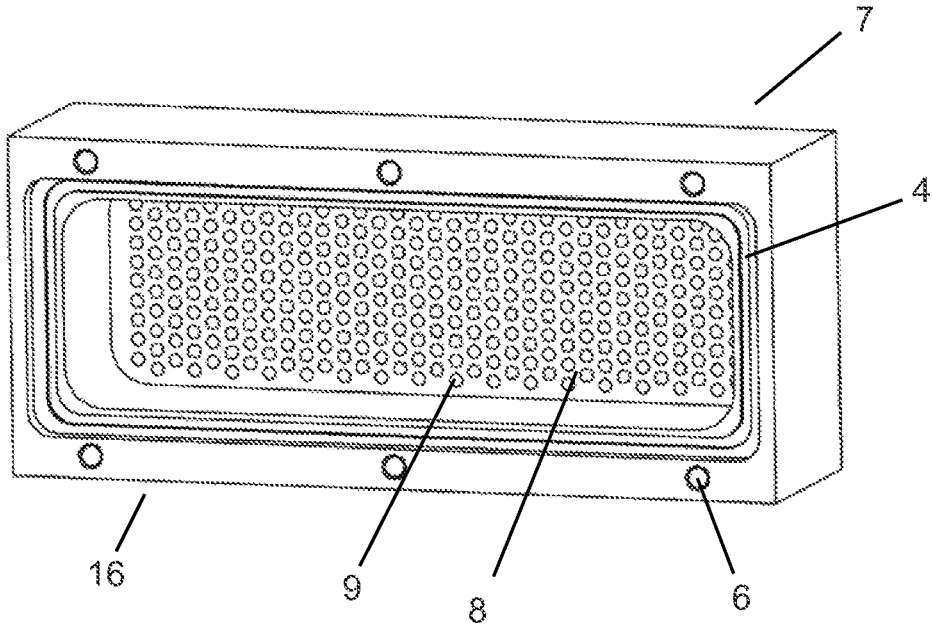

FIG. 2A a cross-sectional view through the line B-B in FIG. 2,

FIG. 3 a spatial view from above of the main chamber with diffusion plate.

Figure 4:
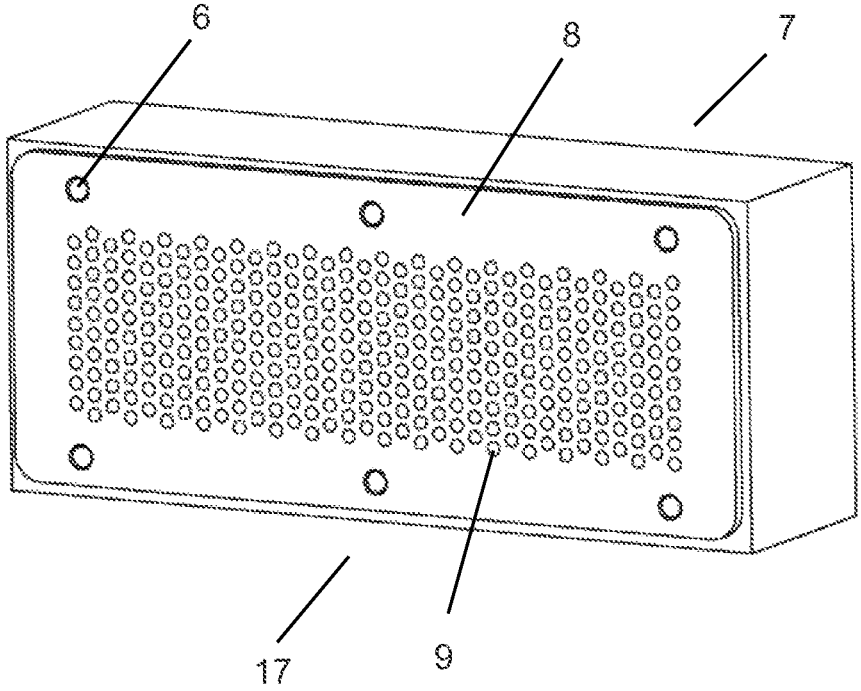

FIG. 4 a spatial view from below of the main chamber with diffusion plate.

Figure 5:
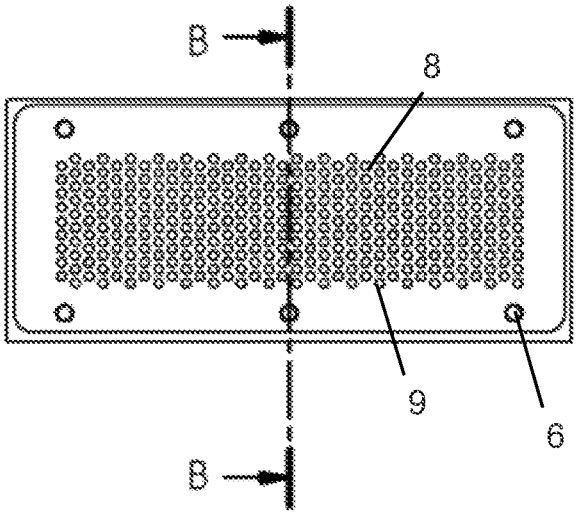

FIG. 5 a top plan view of the main chamber with diffusion plate.

Figure 5A:
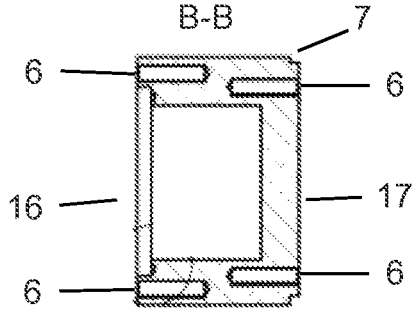
Figure 6:
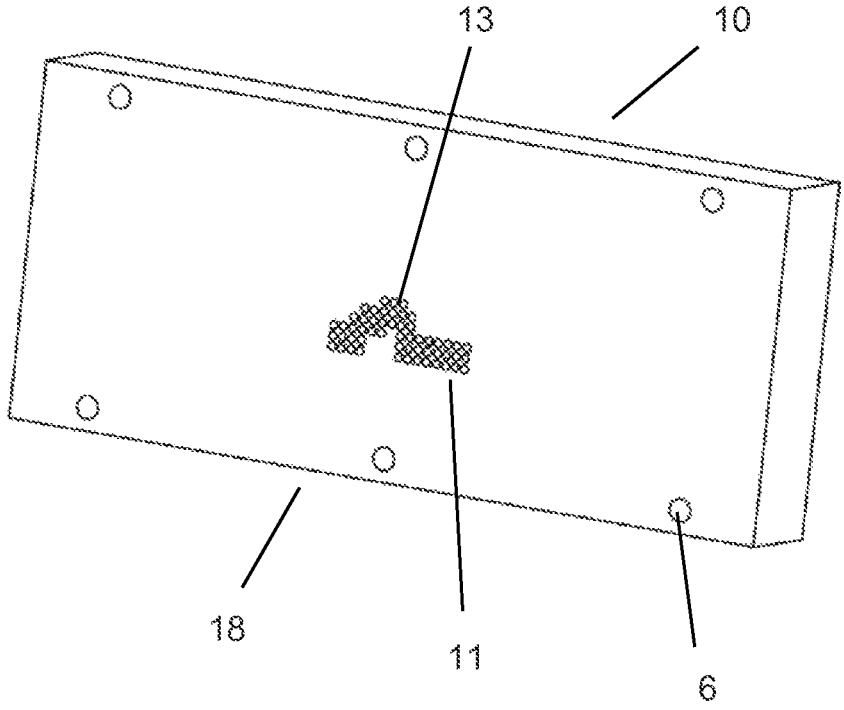
Figure 7:
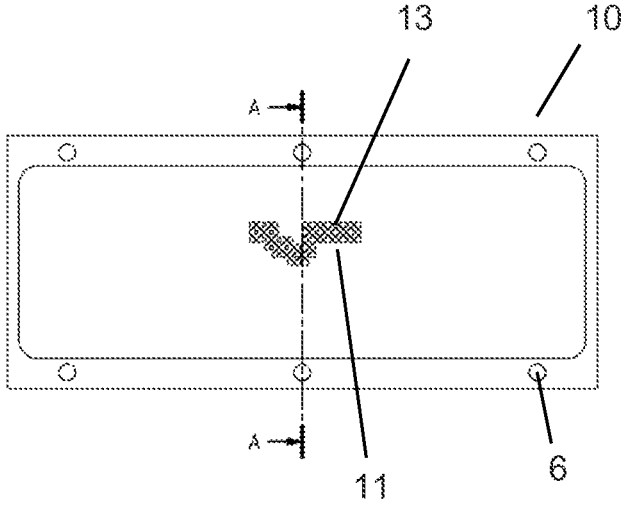

FIG. 5A a cross-sectional view through the line B-B in FIG. 5,

FIG. 6 a spatial view from above of the nozzle plate with a hole pattern adapted to a grinding wheel profile, FIG. 7 a top plan view of the nozzle plate.

Figure 7A:
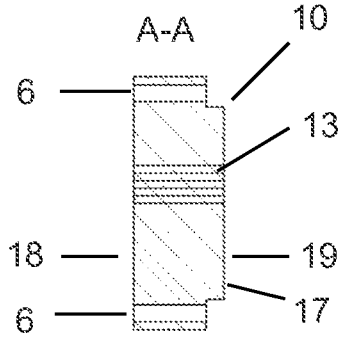
Figure 8:
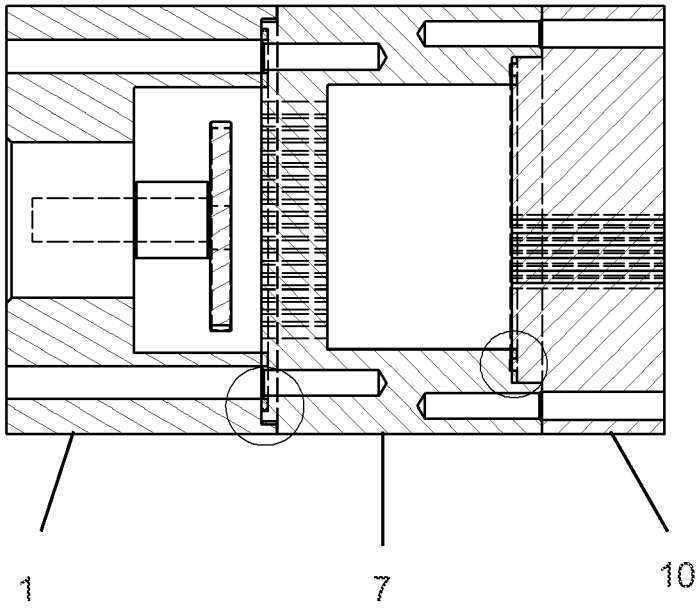
Figure 9:
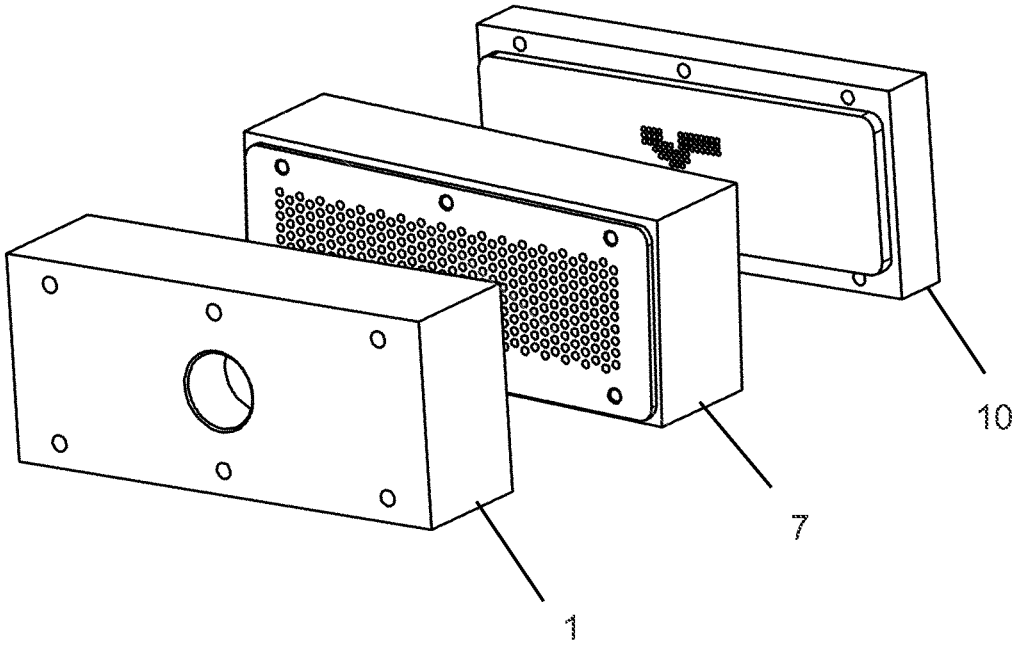
Figure 10:
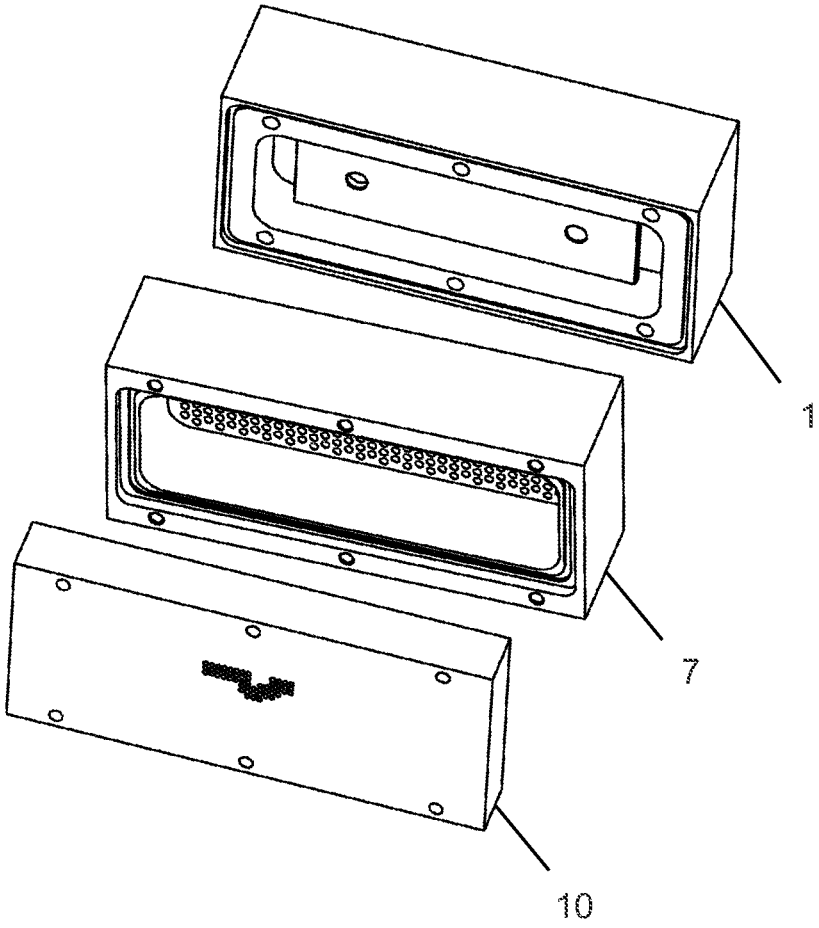

FIG. 7A a cross-sectional view through the line A-A in FIG. 7A,

FIG. 8 a cross-sectional view of the connecting chamber, main chamber, and nozzle plate, FIG. 9 a spatial exploded view from below of the connecting chamber, main chamber, and nozzle plate, and FIG. 10 a spatial exploded view from above of the connecting chamber, main chamber, and nozzle plate.

FIG. 1 depicts a spatial view from above; FIG. 2 a top plan view of the connecting chamber 1 with deflector plate 2; and FIG. 2A a cross-sectional view through the line B-B in FIG. 2. The view from above means with the line of sight counter to the outlet direction of the cooling lubricant. The view from below means with the line of sight in the outlet direction. The connecting chamber 1 has a chamber net 3 from the rear face 15. The connecting chamber 1 has from the front face 14 in the interior a deflector plate 2 that is held on at least two mounting means 5. The connecting chamber 1 has on the front face 14 grooves 4 for O-rings. The connecting chamber 1 has screw openings 6 for screws. The connecting chamber 1 is, for example, roughly 196 mm wide, roughly 84 mm deep, and roughly 55 mm high. The deflector plate 2 is situated roughly 15 mm above the bottom of the connecting chamber 1. The deflector plate 2 is, for example, roughly 3 mm thick, roughly 30 mm wide, and roughly 140 mm long. The mounting means 5 have a diameter of roughly 24 mm. The deflector plate 2 is positioned over the chamber net 3 such that the cooling lubricant is distributed in the connecting chamber 1 before it impinges on the diffusion plate 8 in the main chamber 7, cf. FIG. 3. The size of the deflector plate 2 is, for example, at least 50% of the inner surface of the bottom in the connecting chamber 1.

FIG. 3 depicts a spatial view from above; FIG. 4 a spatial view from below; FIG. 5 a top plan view of the main chamber 7 with diffusion plate 8; and FIG. 5A a cross-sectional view through the line B-B in FIG. 5. The main chamber 7 is removably mounted by the rear face 7 on the front face 14 of the connecting chamber 1. The bottom of the main chamber 7 has a diffusion plate 8 with drilled holes 9. The diffusion plate 8 is depicted both from the front face 16 and from the rear face 17 of the main chamber 7. The drilled holes 9 are distributed over the entire inner surface of the bottom of the main chamber 7. The main chamber 7 has screw openings 6 for screws. The main chamber 7 is, for example, roughly 196 mm wide, roughly 84 mm deep, and roughly 55 mm high. The front face 16 of the main chamber 7 has grooves 4 for O-rings. The drilled holes 9 in the diffusion plate 8 have, for example, a diameter of roughly 2.5 mm. In the transverse direction, the drilled holes 9 are, for example, roughly 4.8 mm apart; and in the longitudinal direction, they are roughly 9.6 mm apart.

FIG. 6 depicts a spatial view from above; FIG. 7 a top plan view of the nozzle plate 10 with a hole pattern 13 adapted to a grinding wheel profile; and FIG. 7A a cross-sectional view through the line A-A in FIG. 7A. The nozzle plate 10 is removably mounted by the rear face 19 on the front face 16 of the main chamber 7. The hole pattern 11 is adapted to a grinding wheel profile. The hole pattern 11 is depicted both from the front face 18 and from the rear face 19 of the nozzle plate 10. The nozzle plate 10 has screw openings 6 for screws. The dimensions of the nozzle plate 10 are adapted to those of the main chamber 7. The drilled holes 9 in the diffusion plate 8 have, for example, a diameter of 2.5 mm. In the transverse direction, the drilled holes 9 are, for example, roughly 4.8 mm apart; and in the longitudinal direction, they are roughly 9.6 mm apart. The drilled holes 13 in the nozzle plate 10 have a diameter of roughly 2 mm. The hole pattern 11 is situated roughly in the center of the nozzle plate. The nozzle plate 10 has a minimum height. The minimum height is, for example, roughly 30 mm.

FIG. 8 depicts a cross-sectional view of the connecting chamber 1, main chamber 7, and nozzle plate 10. FIG. 9 depicts a spatial exploded view from below, and FIG. 10 a spatial exploded view from above of the connecting chamber, main chamber, and nozzle plate. The connecting chamber 1, the main chamber 7, and the nozzle plate 10 are detachably and watertightly connected to each other with screws in screw openings 6 and by means of O-rings in grooves 4 to form a device according to the invention. The connecting chamber 1, the deflector plate 2, the main chamber 7, and the nozzle plate 10 are made of aluminum in this example.

EXAMPLE

A nozzle plate 10 with a hole pattern 11 adapted to the wheel profile of a grinding wheel with a 400 mm diameter was used. A desired cooling lubricant flow rate of 25 m/sec was set. A grinding wheel speed of rotation of 1200 $min^{-1}$ was set. A cooling lubricant pressure of 5 bar was set. A coherent jet of cooling lubricant was applied to the grinding wheel with the nozzle according to the invention. A laminar flow was produced by the nozzle.

No burn marks were observed on the workpieces. A high throughput of ground workpieces was achieved. A laminar flow of the cooling lubricant was observed.

COMPARATIVE EXAMPLE

The comparative example was carried out under the same conditions as the example. The only difference was that a flat spray nozzle of the prior art was used.

Burn marks were observed on the workpieces. A lower throughput was achieved. It was observed that the laminar flow of the cooling lubricant was disrupted.

The advantages of the nozzle according to the invention are summarized in Table 1.

TABLE 1

| Result | Nozzle (Invention) | Nozzle (Prior Art) |
|---|---|---|
| Burn marks on the workpieces | None | Observed |
| Throughput achieved | High | Low |
| Laminar flow | Present over a wide distance | Turbulent flow began directly after leaving nozzle |

LIST OF REFERENCE CHARACTERS

1 connecting chamber
2 deflector plate
3 chamber inlet
4 grooves for an O-ring
5 mounting means for the deflector plate
6 screw openings
7 main chamber
8 diffusion plate
9 drilled holes in the diffusion plate
10 nozzle plate/output nozzle plate homogenization plate
11 hole pattern adapted to the grinding wheel profile
13 drilled holes
14 connecting chamber from above or front face
15 connecting chamber from below or back face
16 main chamber from above or front face
17 main chamber from below or back face
18 nozzle plate from above or front face
19 nozzle plate from below or back face

The invention claimed is:

1. A nozzle for cooling lubricant, comprising:

a connecting chamber with a chamber inlet and with a deflector plate mounted in an interior of the connecting chamber, an assembly including a main chamber and a diffusion plate with drilled holes, the main chamber and the diffusion plate overlapping each other to define a two-layer structure, a rear face of the two-layer structure being removably mounted as a block on a front face of the connecting chamber, and a holed nozzle plate including a hole pattern configured to match with a grinding wheel profile, a rear face of the nozzle plate being removably mounted on a front face of the main chamber.

2. The nozzle according to claim 1, wherein the deflector plate has no drilled holes for passage of the cooling lubricant.

3. The nozzle according to claim 1, wherein the diffusion plate is installed with drilled holes in a bottom of the main chamber and wherein the drilled holes extend over an entire inner surface of the bottom of the main chamber.

4. The nozzle according to claim 1, wherein the deflector plate is positioned in the connecting chamber above the chamber inlet such that the cooling lubricant is distributed in the connecting chamber before it impinges on the diffusion plate of the main chamber and a size of the deflector plate is at least 50% of an inner surface of a bottom in the connecting chamber.

5. The nozzle according to claim 1, wherein the deflector plate is disposed parallel to a bottom of the connecting chamber.

6. The nozzle according to claim 1, wherein the front face of the connecting chamber and the front face of the main chamber have grooves for O-rings.

7. The nozzle according to claim 1, wherein the connecting chamber, the main chamber, and the nozzle plate have screw openings for connecting.

8. The nozzle according to claim 1, wherein the connecting chamber, the main chamber, and nozzle plate are connected by screws in screw openings and O-rings in grooves to form a device.

9. The nozzle according to claim 1, wherein the drilled holes in the diffusion plate have a diameter of 2 mm to 4 mm and drilled holes in the nozzle plate have a diameter of 1 mm to 3 mm.

10. The nozzle according to claim 1, wherein the connecting chamber with deflector plate, main chamber, and nozzle plate contain aluminum or alloyed high-grade steel.

11. A method of emitting a coherent jet of cooling lubricant onto a grinding wheel comprising:

providing the nozzle for cooling lubricant according to claim 1, adapting the nozzle plate with the hole pattern to the grinding wheel profile, setting a desired cooling lubricant flow rate which corresponds to a specific cooling lubricant pressure for a grinding process, and setting a specific grinding wheel peripheral speed.

12. The method according to claim 11, wherein the desired cooling lubricant flow rate corresponds roughly to the specific grinding wheel peripheral speed.

13. The method according to claim 11, wherein a laminar flow is created by the nozzle for cooling lubricant.

14. A method comprising:

providing the nozzle for cooling lubricant according to claim 1, and supplying cooling lubricant to a point of contact between a workpiece and a tool for removal of material.

15. The method according to claim 14, wherein the supplying is done during grinding processes.

* * * * *

UNITED STATES PATENT AND TRADEMARK OFFICE

CERTIFICATE OF CORRECTION

PATENT NO. : 8,529,312 B2
APPLICATION NO. : 13/807866
DATED : September 10, 2013
INVENTOR(S) : Marc Kritzky et al.

It is certified that error appears in the above-identified patent and that said Letters Patent is hereby corrected as shown below:

In the claims, column 8, lines 8-9, delete the following text from claim 11:

"of emitting a coherent jet of cooling lubricant onto a grinding wheel".

Signed and Sealed this
Twelfth Day of November, 2013

Teresa Stanek Rea

Teresa Stanek Rea
*Deputy Director of the United States Patent and Trademark Office*